US005141444A

United States Patent [19]

Redmond et al.

[11] Patent Number: 5,141,444

[45] Date of Patent: Aug. 25, 1992

[54] ELASTOMERIC CONNECTOR WITH CONTACT WIPE

[75] Inventors: John P. Redmond, Mechanicsburg; Ray N. Shaak, Lebanon, both of Pa.

[73] Assignee: AMP Incorporated, Harrisburg, Pa.

[21] Appl. No.: 744,134

[22] Filed: Aug. 13, 1991

[51] Int. Cl.[5] ..... H01R 23/70

[52] U.S. Cl. ..... 439/59; 439/86; 439/91

[58] Field of Search ..... 439/59-62, 439/66, 74, 86, 91, 591, 65, 387

[56] References Cited

U.S. PATENT DOCUMENTS 4,643,499 2/1987 Mitchell ..... 439/66
4,766,371 8/1988 Moriya ..... 439/66
4,820,170 4/1989 Redmond et al. ..... 439/66
4,867,689 9/1989 Redmond et al. ..... 439/74

*Primary Examiner*—Neil Abrams
*Attorney, Agent, or Firm*—William B. Noll

[57] ABSTRACT

An electrical connector (14) for interconnecting circuit boards (12, 50) includes an elastomeric pad (34, 36) having sharp fiber ends (42, 46) resiliently driven to penetrate oxides to provide an anisotropic, low resistance, stable electrical interface between the board circuits when driven by spring contacts (28, 32) in one embodiment, and by rigid contacts (64, 72) in another embodiment, wherein the pad is positioned to seal the interconnector by covering the connector interior.

5 Claims, 4 Drawing Sheets

ELASTOMERIC CONNECTOR WITH CONTACT WIPE

This invention relates to an electrical connector for interconnecting arrays of contacts between circuits such as circuit boards which utilizes an anisotropic, elastomeric connector having sharp ended fibers arranged to provide contact wipe upon engagement of circuits.

BACKGROUND OF THE INVENTION

U.S. Pat. No. 4,820,170 granted Apr. 11, 1989 is directed toward a type of elastomeric electrical connector wherein conductive fibers are embedded in laminations of dielectric material. The dielectric material is itself elastomeric and the fibers are displaced transverse to the plane of the material forming the connector. Compression of the connector results in the fibers ends engaging conductive surfaces as for example, surfaces of printed circuit boards to effect an interconnection thereof. U.S. application No. 07/652,804 filed Feb. 12, 1991 details an improvement on the forgoing patent wherein circuits disposed on a substrate are connected by the patented elastomeric connector. Typically the fibers are made of carbon filaments and the elastomeric material is made of silicone rubber or material having similar characteristics. The forgoing patent and application feature an interconnection which is redundant by virtue of the numbers of fibers embedded in the elastomer and further feature electrical interfaces which are in effect sealed by the elastomer surrounding the fiber ends. Additionally, these prior art devices contain a relatively broad area of contact to be contrasted with the typical electrical interface which is depended upon a number of asperities, relatively few in number for each contact definition. These prior art devices furthermore are in essence anisotropic meaning that the connector conducts in one direction only. Typically the direction is along the length of the fibers or transverse to the thickness of the elastomeric sheet material representing the connector. An advantage of this arrangement is that contacts on close centers can be effectively interconnected to other contacts through the elastomer without adjacent contacts being shorted out.

The present application represents an improvement over the forgoing devices referred to in the patent and application and has as an object the provision of an electrical interconnection through an elastomeric connector aimed to wipe the contacts of at least one of the surfaces to be connected and to thus provide an enhanced electrical interface. It is yet a further object to provide an elastomeric connector which is positioned to seal the opening interconnector as well as sealing the actual electrical interface served by the elastomeric connector. It is still a further object to provide an elastomeric connector which seals and wipes the contacts connected by such connector through a novel placement and deformation in relation to circuits including a connector housing.

SUMMARY OF THE INVENTION

The present invention achieves the forgoing objectives through the provision of an electrical connector for interconnecting circuits such as the circuits carried by printed circuit boards which are typically ended in circuit contact areas on the surface of such boards through an elastomeric pad having sharp fiber ends resiliently driven by being compressed through an engagement of the circuit boards and/or through a housing to penetrate oxides on the surfaces of at least one of the circuits. The elastomeric connector is anisotropic so as to connect in one direction only and thereby allow for closely centered contacts to be interconnected. The connector is provided in a sheet form, relatively thin compared to its area and in one embodiment it is bonded to a connector housing proximate an opening into the interior thereof, positioned so that the insertion of a circuit such as a printed circuit board into the connector folds and compresses the connector sheet material to effect an interconnection between the circuits and contacts of the inserted board and the contacts within the housing connected to a further board. The elastomeric connector, as folded and formed is compressed so that the fibers therein engage the contacts of the two boards and provide an interconnection. The insertion of the one board into the connector provides a wipe of the contacts in the connector to clean such contacts of corrosion or oxide products, the elastomeric nature of the material used for the connector effectively sealing each of the contact points by surrounding the fiber ends in compression. Furthermore, the sheet characteristics of the material seal the opening around the circuit being inserted into the connector.

An alternative embodiment of the invention features an elastomeric connector of a lamina type containing conductive fibers bonded as by adhesive to the surface of a circuit device such as a printed circuit board and arranged with the housing mounted on a further board to be compressed as the first board is inserted into the housing, the contacts of the first and second boards being engaged and compressing the elastomeric connector. A wipe is provided of the contacts on the board carrying the housing in this further alternative embodiment.

The invention thus in one embodiment embraces the concept of providing an elastomeric connector compressed between a fixed contact surface and a contact surface carried by a spring element as well as between contact surfaces which are both relatively fixed, the resilience of the elastormeric connector providing the necessary normal force to effect a contact interface between the two surfaces.

DETAILED DESCRIPTION OF THE INVENTION

Figure 1:
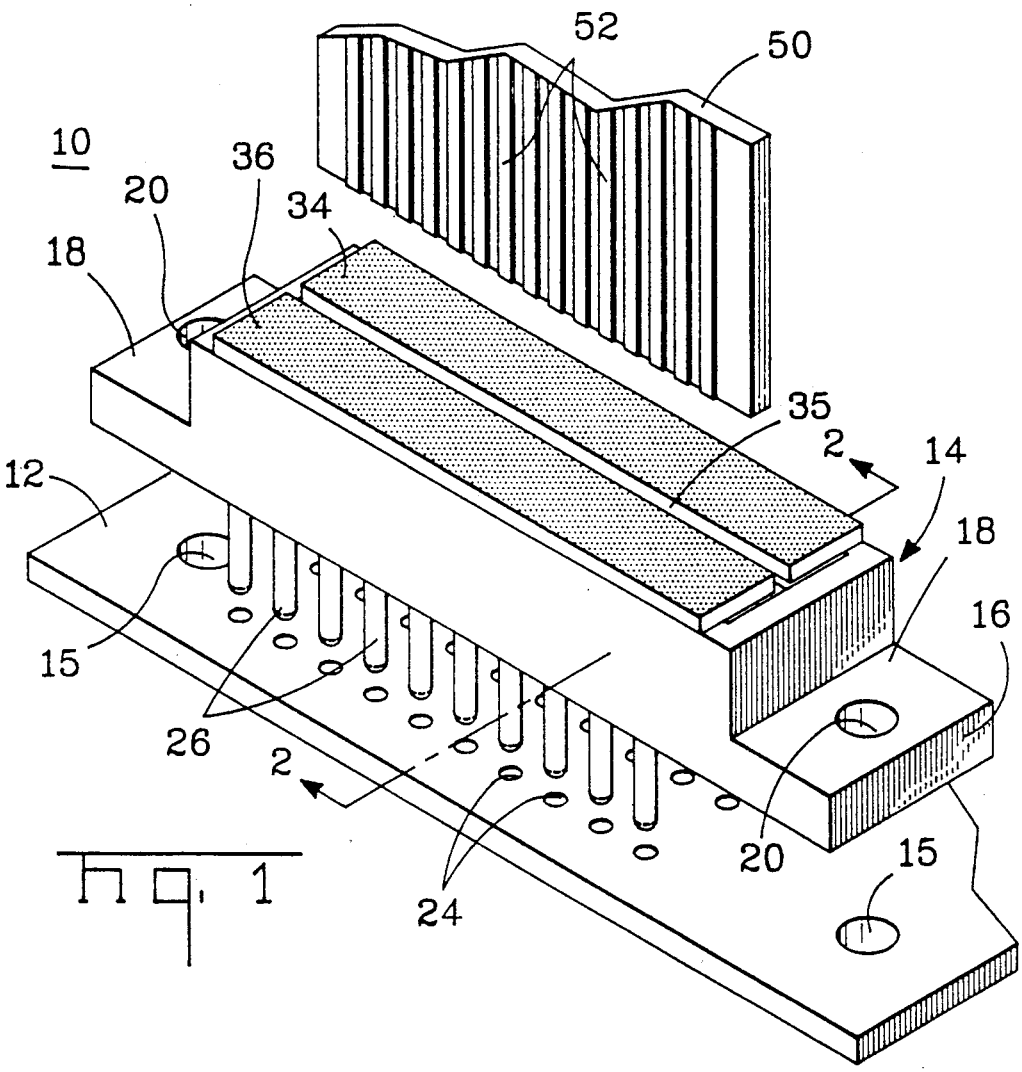
FIG. 1 is a perspective view showing a connector in accordance with the invention prior to insertion in a circuit device, such as a printed circuit board.
Figure 2:
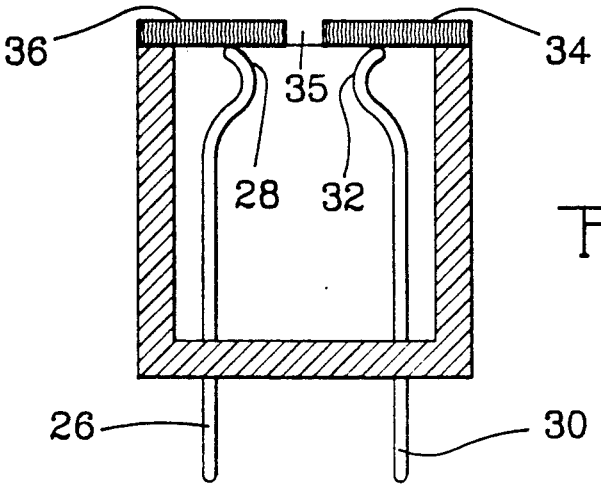
FIG. 2 is a sectional view of the connector shown in FIG. 1 taken along lines 2—2.

Referring now to FIG. 1 an assembly 10 includes a circuit device such as a printed circuit board 12 and a connector 14 positioned thereover and prior to assembly with such board. The board 12 may be considered as a back panel or mother board to which numerous daughter boards are attached to form a circuit function. The board 12 includes (not shown) a number of circuit traces on the surfaces thereof or embedded therewithin, as known in the art, which lead to a number of holes 14 which are typically solder coated. An interconnection of these traces within board 12 and to certain further circuit devices such as printed circuit boards or daughter cards is necessary to effect a circuit function for computers, business machines, communication devices and the like. The connector 14 positioned above board 12 and prior to assembly therewith includes a housing 16, typically of an engineering dielectric and insulating plastic material molded to include on the ends feet 18 and apertures 20 to receive fasteners (not shown) which extend therethrough and through holes 15 in board 12 to fasten the connector 14 to such board. Typically numerous connectors 14 would be mounted on board 12 to provide circuit functions. As can be discerned from FIGS. 1 and 2 the housing 16 includes internally two rows of contacts shown as 26 and 30 which have post portions extending from the undersurface of the housing 16 and are aligned with the holes 24 in board 12. These are in practice inserted in such holes and may be interconected thereto by the use of solder or resilient spring sections or the like. The contacts 26 and 30 each have an upper contact end shown as 28 and 32 which are rounded and which are intended to be resilient in the embodiment shown in FIG. 1 in a sense transverse to the length of the contacts. Secured to the top of the housing 14 is a contact structure comprised of elastormeric pads 34 and 36. These are bonded such as by an adhesive to the top surfaces of housing 16 and made to extend to cover over the opening within housing 16 in the manner shown in FIGS. 1 and 2. Along the center line of the connector there is provided a slit or small gap 35 between the two pads 34 and 36.

Figure 8:
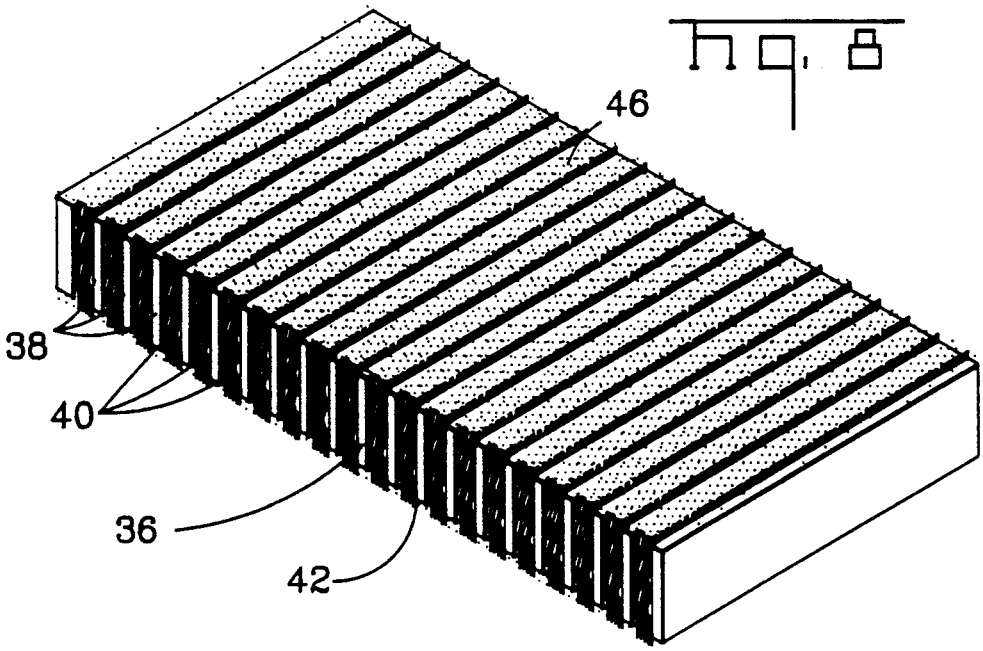
FIG. 8 is an enlarged perspective view of an elastomeric connector.

The pads 34 and 36 are each comprised of an elastomeric and lamina sheet material which is depicted in FIG. 8. As can be discerned, the pad 36, typical of pad 34, includes laminations of elastomeric material 38 and conductive fibers such as carbon fibers 40 which each have relatively sharp ends 42 and 46 arranged transverse to the length and area of the connectors formed by the pads. The aforementioned patent and application may be referred to for a more detailed description of the elastomeric connector utilized for the pads 34 and 36. It is to be understood that these pads are relatively thin being on the order of, for example 0.015 to 0.050 inches in thickness. Within the structure of the pads are hundreds of contact points formed by the ends 42 and 46 and the conductive fibers 40 in the laminations thereof. The layers of conductive fibers are spaced relatively close together, as for example in layers on the order of 0.010 inches in pitch so that in a typical application used to interconnect conductive traces and conductive pads on the boards, numerous conductive laminations will be in engagement with the contacts.

Figure 3:
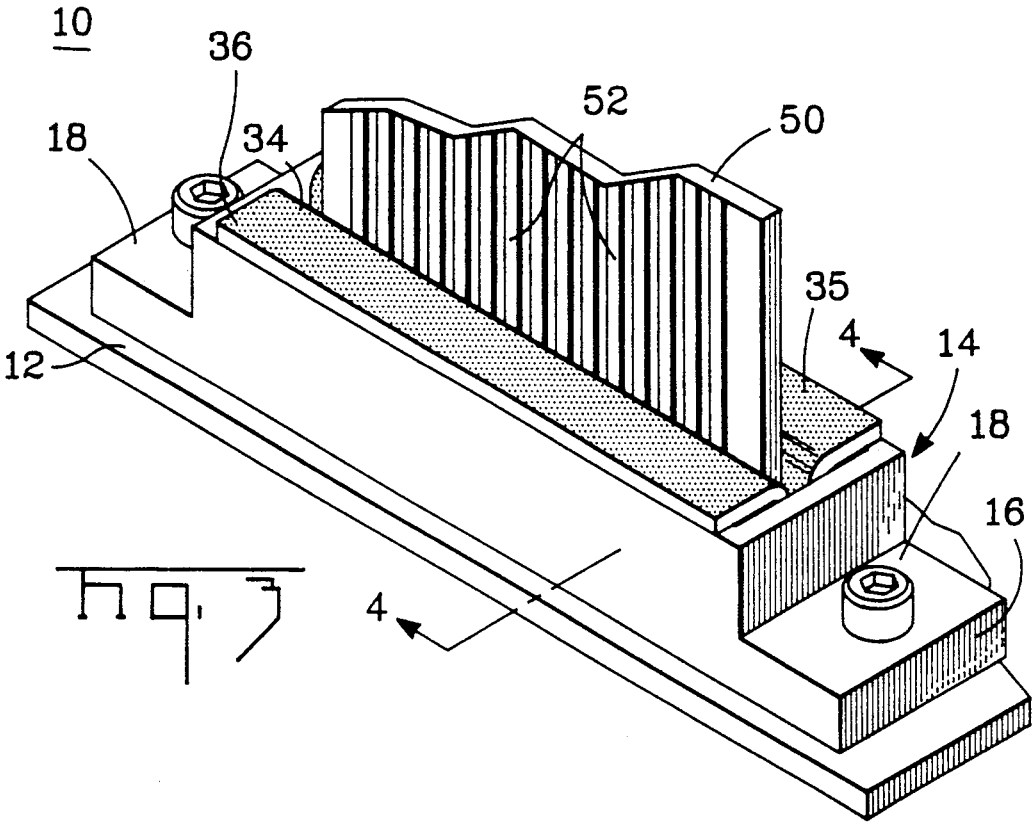
FIG. 3 is a perspective view showing the connector and board of FIG. 1 assembled with the insertion of a second circuit device in the form of a board therein.
Figure 4:
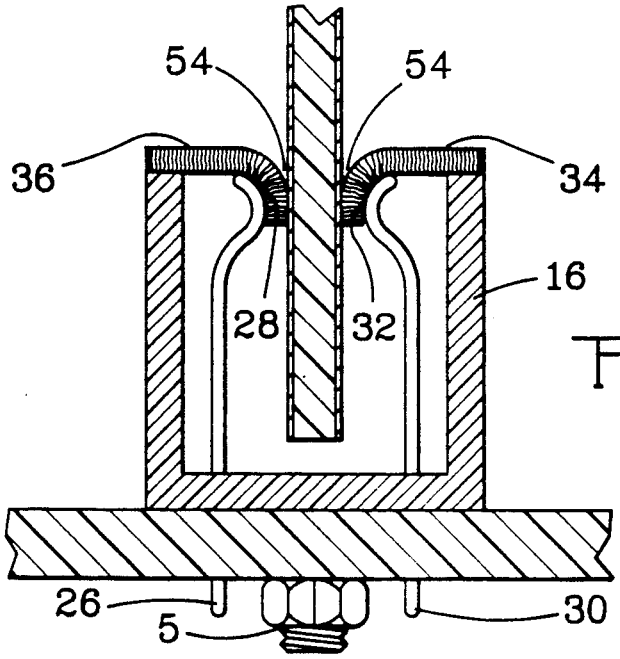
FIG. 4 is a sectional view taken along lines 4—4 of FIG. 3.

Referring back to FIG. 2 and further to FIGS. 3 and 4 the contacts 26 and 30 are spaced apart as at ends 28 and 32 by a given distance selected to be substantially greater than the thickness of a circuit device such as a printed circuit board inserted through slit 35 between the contacts 28 and 32. The circuit device 50 may be a printed circuit board, a daughter board as heretofore mentioned, made to include circuit traces 52 on the surfaces thereof which end in contacts along the edges thereof on each side. These contacts are interconnected by traces not shown to components such as integrated circuits and discrete electronic devices carried on board 50 and interconnected through board 12 to other components carried on other printed circuit boards. As can be seen particularly in FIG. 4 a board 50 inserted through the slit 35 and into the connector housing 16 of connector 14 deforms the elastomeric pads 34 and 36, bending such pads inwardly to engage on an inner surface the contact ends 28 and 32 and to engage on the outer surface thereof the traces 52 of board 50. As can be appreciated during insertion of board 50 the contact traces 52 will be wiped by the elastomeric connector, the sharp ends of the fibers engaging the contact surfaces. Also to be appreciated is the bending of the contact pads 34 and 36 around the contacts 28 and 32 and the deflection thereof causing an embedment of the sharp ends of the fibers into the contact surfaces of 28 and 32 to provide a high number of contacts interconnecting the contacts 52 and the contacts of the connector, affectively sealing the opening of the connector from material such as debris, corrosive gases, dust and the like. While the seal is not particularly gas tight it is effective to reduce the material which may find its way into the interior of the connector and block the electrical interface.

In FIG. 4 the opposite ends of contacts 26 and 30 are effectively joined to the board 12, the traces there are (not shown) residing on the under surface of the board and soldered or interconnected by resilient spring sections (compliant pin sections). It was discovered that the wiping action just described results in an improved electrical interconnection between circuit contacts.

Figure 5:
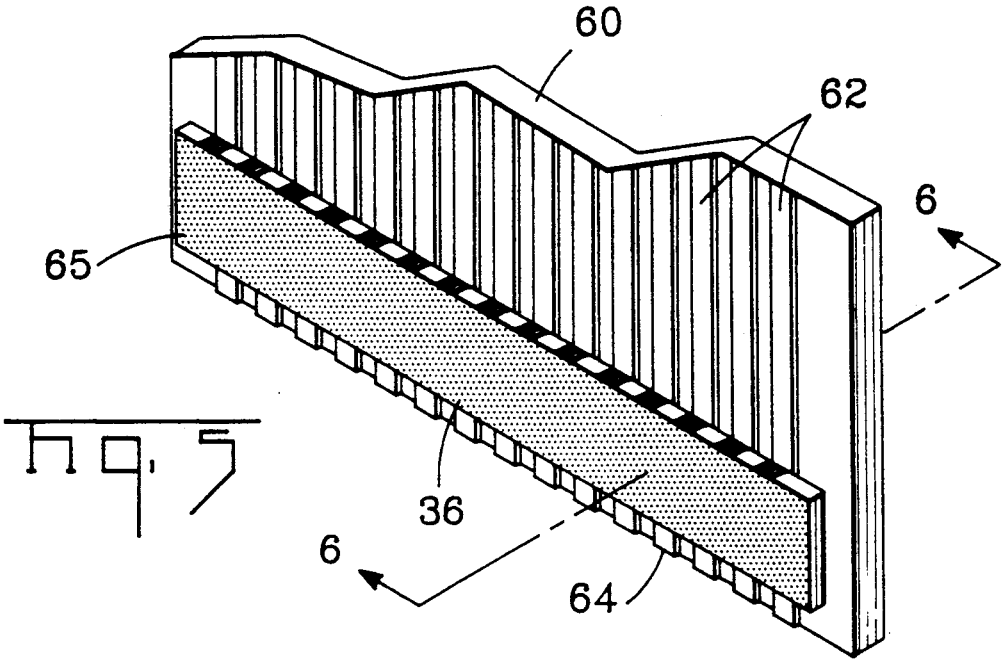
FIG. 5 is a perspective view of a circuit board having a connector attached thereto in an alternative embodiment.
Figure 6:
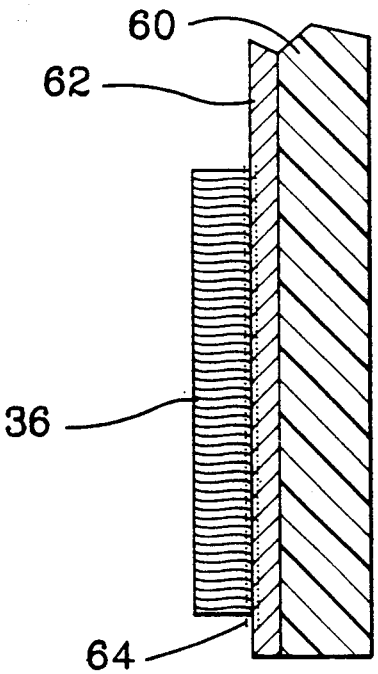
FIG. 6 is an elevational and partially sectioned view taken along lines 6—6 of FIG. 5.
Figure 7:
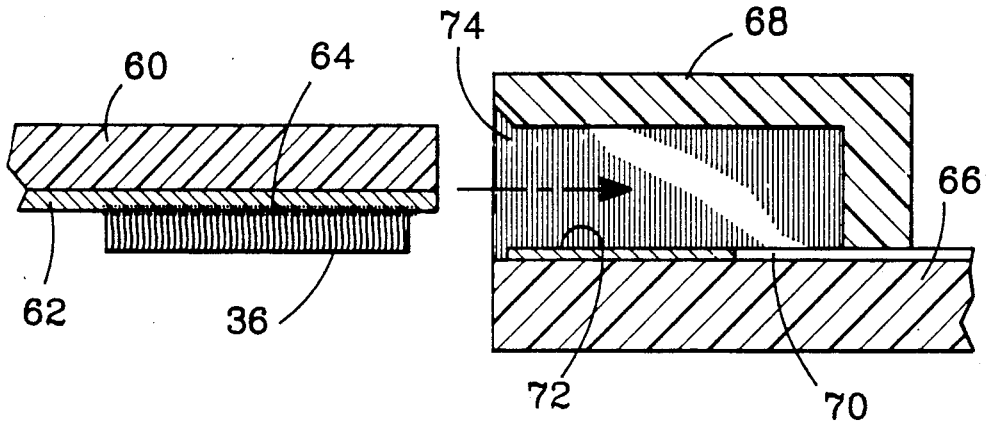
FIG. 7 is a sectional view, in elevation, of boards including the connector of the invention prior to assembly.

Turning now to FIGS. 5 and 6 an alternative embodiment of the invention is shown utilized with a circuit device such as a daughter card 60 carrying traces 62 ending in circuit contacts 64. FIG. 6 shows these elements in partial section along the end of the edge end of the board 60. In the embodiment shown in FIGS. 5 and 6 the elastomeric connector 36, in a pad or sheet form is placed over the contacts 64 and bonded thereto around the periphery as at 65 by the use of a suitable adhesive. The pad 36 is elastomeric as heretofore described and, after being bonded to board 60 resides thereon permanently. FIG. 7 shows board 60 carrying an elastomeric connector pad 36 preparatory to insertion in relation to a further board 66 having a housing 68 thereon and having contact traces 70 ending in contacts 72 on the upper surface thereof. The housing of 68 may be considered to have a cross-sectional configuration as shown with a beveled entry 72 and means not shown at the ends thereof to mount the housing on the board 66. The interior of the housing 68 is dimensioned to be slightly less in width than the dimension of the board 60 and the pad 36 so as to cause the pad to be compressed upon insertion of board 60 into the opening of housing 68. As can be appreciated from FIG. 7 the fiber ends, specifically the ends of 42 protruding from the under surface of pad 36, will engage and wipe and contact the surface of contact 72 to effect a wiping and sealing of the interface between the contact 64 and 72.

We claim:

1. An electrical connector for interconnecting at least two separable circuits each including at least one contact, a housing fixedly mounted to at least one of said circuits including an interior volume and an opening to receive and position the other of said circuits when slidingly inserted through said opening into said volume, an elastomeric pad of a given thickness including conducive elements embedded in the elastomeric material of the pad having sharp ends adapted to bite into the contacts of the circuits nd provide an interconnection therebetween, means mounting the said pad on said housing in a position relative to said contacts to cause said pad to be compressed in the even thickness nd seal the opening and interior volume of said housing with the said element ends engaging and wiping at least one of said contacts and penetrating the other of said contacts responsive to insertion of the other of said circuits into said housing.

2. The connector of claim 1 wherein said pad include separate elements attached to said housing to define a slit therebetween adapted to receive the other circuit inserted into said slit with the thickness of the said other circuit in conjunction with the given thickness of the said pad operating to effect the sealing and compression of said pad between the contacts of the one and other circuits.

3. The connector of claim 1 wherein the said pad is compressed of a lamina structure of conductive fibers embedded in an insulating elastomeric material to define a thin sheet of resilient characteristic with the fibers oriented transversely to the major area dimension of said sheet.

4. The connector of claim 1 wherein one of the said contacts includes a spring section resiliently driving the said pad into engagement with the other contact.

5. An electrical connector for interconnecting at least two separable circuits each including at least one contact, a housing mounted on one of said circuits including an interior volume and an opening to receive and position the other of said circuits when slidingly inserted through said opening and into said volume, an elastomeric pad of a given thickness including conductive elements embedded in the elastomeric material of the pad having sharp ends adapted to bite into the contacts and provide an interconnection therebetween, means mounting the said pad to the other of said circuits in a position relative to the said contacts to cause said pad to be compressed by the given thickness of said pad nd the said housing to seal the opening and interior volume of said housing with the element ends engaging and wiping at least one of said contacts and penetrating the other of said contacts responsive to insertion of the other of said circuits into said housing.

* * * * *

UNITED STATES PATENT AND TRADEMARK OFFICE

CERTIFICATE OF CORRECTION

PATENT NO. : 5,141,444

DATED : August 25, 1992

INVENTOR(S) : John Peter Redmond, et al.

It is certified that error appears in the above-identified patent and that said Letters Patent is hereby corrected as shown below:

Claim 1, Column 5, Line 10 - replace "nd" with -- and --;

Claim 1, Column 5, Line 13 - replace "even" with -- given --;

Claim 1, Column 5, Line 14 - replace "nd" with -- and --;

Claim 3, Column 6, Line 2 - replace "compressed" with -- comprised --; and

Claim 5, Column 6, Line 23 - replace "nd" with -- and --.

Signed and Sealed this

Twenty-first Day of September, 1993

Bruce Lehman

*Attest:*

BRUCE LEHMAN

*Attesting Officer*

*Commissioner of Patents and Trademarks*